US011913680B2

(12) United States Patent
Zhai et al.

(10) Patent No.: US 11,913,680 B2
(45) Date of Patent: Feb. 27, 2024

(54) HEAT PUMP SYSTEM

(71) Applicant: Carrier Corporation, Palm Beach Gardens, FL (US)

(72) Inventors: Hui Zhai, Shanghai (CN); Guangyu Shen, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 31 days.

(21) Appl. No.: 17/573,947

(22) Filed: Jan. 12, 2022

(65) Prior Publication Data

US 2022/0221199 A1 Jul. 14, 2022

(30) Foreign Application Priority Data

Jan. 14, 2021 (CN) ..... 202110047744.9

(51) Int. Cl.

| | |
|---|---|
| ***F25B 13/00*** | (2006.01) |
| ***F24D 11/02*** | (2006.01) |
| ***F24D 19/10*** | (2006.01) |
| ***F24H 4/04*** | (2006.01) |

(52) U.S. Cl.

CPC ..... *F25B 13/00* (2013.01); *F24D 11/0214* (2013.01); *F24D 19/1039* (2013.01); *F24H 4/04* (2013.01); *F24D 2200/123* (2013.01); *F25B 2313/0272* (2013.01); *F25B 2313/02742* (2013.01)

(58) Field of Classification Search

CPC ..... F24D 11/0214; F24D 19/1039; F24D 2200/123; F25B 2313/02742; F25B 2313/0272; F25B 2313/003; F25B 2313/0233; F25B 2313/0232; F25B 2313/0252; F25B 2313/0253; F25B 41/24; F25B 30/02; F25B 29/003; F25B 39/00; F25B 49/02

See application file for complete search history.

(56) References Cited

U.S. PATENT DOCUMENTS

2021/0318045 A1* 10/2021 Shen ..... F25B 30/02

FOREIGN PATENT DOCUMENTS

| | | | | |
|---|---|---|---|---|
| CN | 101655281 A | * | 2/2010 | |
| CN | 101788208 A | * | 7/2010 | |
| CN | 101655281 B | * | 6/2012 | |
| CN | 103370584 A | * | 10/2013 | ..... F24D 17/02 |
| CN | 106152263 A | * | 11/2016 | ..... F25B 13/00 |
| CN | 106152332 A | * | 11/2016 | |
| CN | 105318454 B | * | 4/2018 | ..... F24F 1/16 |
| CN | 112050287 A | * | 12/2020 | ..... F24D 17/0005 |

* cited by examiner

*Primary Examiner* — Kun Kai Ma
(74) *Attorney, Agent, or Firm* — CANTOR COLBURN LLP

(57) ABSTRACT

A heat pump system includes a first unit; a second unit connected to a first flow path of the first unit; and a third unit connected to a second flow path of the first unit and connected to the second unit. The heat pump system can operate in a cooling and water heating mode and a heating and water heating mode, wherein, in the cooling and water heating mode, the heat pump system is configured to switch a switching assembly to a first position and connect the at least one first heat exchangers and the second heat exchanger in series; in the heating and water heating mode, the heat pump system is configured to switch the switching assembly to a second position and connect the second heat exchanger and the at least one third heat exchangers in parallel.

10 Claims, 1 Drawing Sheet

HEAT PUMP SYSTEM

FOREIGN PRIORITY

This application claims priority to Chinese Patent Application No. 202110047744.9, filed Jan. 14, 2021, and all the benefits accruing therefrom under 35 U.S.C. § 119, the contents of which in its entirety are herein incorporated by reference.

TECHNICAL FIELD

The present disclosure relates to a heat exchange device, in particular to a heat pump system with a heat recovery function.

BACKGROUND

Nowadays, heat pump systems with a water heating function, which comprise a thermal unit that recovers part of the heat to produce hot water, are often used for residential and villa application. The system can recover heat to produce hot water while heating or cooling.

SUMMARY

The purpose of the present disclosure is to solve or at least alleviate the problems in the prior art.

According one aspect, a heat pump system is provided, comprising:

a first unit which comprises a compressor, a switching device connected to the compressor, a first flow path and a second flow path connected to the switching device, and at least one first heat exchangers on the first flow path, wherein the switching device is switchable between a first position and a second position so as to deliver refrigerant compressed by the compressor to the first flow path or the second flow path, respectively;

a second unit connected to the first flow path of the first unit and comprising a second heat exchanger; and a third unit connected to the second flow path of the first unit and connected to the second unit, and comprising at least one third heat exchangers;

wherein the heat pump system is capable of operating in a cooling and water heating mode and a heating and water heating mode, wherein, in the cooling and water heating mode, the heat pump system is configured to switch the switching assembly to the first position and connect the at least one first heat exchangers and the second heat exchanger in series, and the refrigerant compressed by the compressor passes through the at least one first heat exchangers and the second heat exchanger connected in series via the first flow path, and returns to the compressor after passing through a first expansion device and the at least one third heat exchangers; and wherein, in the heating and water heating mode, the heat pump system is configured to switch the switching assembly to the second position and connect the second heat exchanger and the at least one third heat exchangers in parallel, and the refrigerant compressed by the compressor passes through the second heat exchanger and the at least one third heat exchangers connected in parallel via the second flow path, and returns to the compressor after passing through a second expansion device and the at least one first heat exchangers.

Optionally, in an embodiment of the heat pump system, the heat pump system further comprises a cooling mode. In the cooling mode, the heat pump system is configured to switch the switching assembly to the first position, and bypass the second heat exchanger.

Optionally, in an embodiment of the heat pump system, the heat pump system further comprises a heating mode. In the heating mode, the heat pump system is configured to switch the switching assembly to the second position, and shut off the bypass branch where the second heat exchanger is located.

Optionally, in an embodiment of the heat pump system, the first unit comprises a first regulating valve connected in parallel with the at least one first heat exchanger. In the cooling and water heating mode, opening of the first regulating valve is adjustable so as to regulate the amount of refrigerant bypassing the at least one first heat exchangers. In the heating and water heating mode, the first regulating valve is closed.

Optionally, in an embodiment of the heat pump system, the at least one first heat exchangers comprise a plurality of first heat exchangers connected in parallel. In the cooling and water heating mode, the amount of refrigerant condensed in the at least one first heat exchangers is regulated by regulating the number of the first heat exchangers activated.

Optionally, in an embodiment of the heat pump system, the at least one third heat exchangers comprise a plurality of third heat exchangers connected in parallel. A first expansion device is arranged on each bypass branch where each of the third heat exchanger is located, wherein the first expansion device performs a throttling function in the cooling and water heating mode, and acts as a flow regulating valve to control the flow of refrigerant passing through the third heat exchangers in the heating and water heating mode.

Optionally, in an embodiment of the heat pump system, the at least one third heat exchangers comprise heat exchangers for an air conditioning system and heat exchangers for a floor heating system.

Optionally, in an embodiment of the heat pump system, in the cooling and water heating mode, the second expansion device is located downstream of the at least one first heat exchangers on the first flow path. The heat pump system further comprises a first check valve connected in parallel with the second expansion device. In the cooling and water heating mode, the second expansion device is fully opened or closed, and the refrigerant passing through the at least one first heat exchangers flows to the second heat exchanger. In the heating and water heating mode, the first check valve inhibits the passage of fluid, and the second expansion device performs a throttling function.

Optionally, in an embodiment of the heat pump system, the first flow path is branched into a main flow path passing through the second unit and a bypass branch. A second check valve, a second heat exchanger and a flow regulating valve are arranged in sequence on the main flow path. The second check valve only allows the fluid flowing to the second heat exchanger to pass through. The bypass branch is connected to the third unit and is provided with a solenoid valve thereon. The flow regulating valve is fully opened in the cooling and water heating mode, and regulates the flow of refrigerant passing through the second heat exchanger in the heating and water heating mode.

Optionally, in an embodiment of the heat pump system, the second flow path is branched into a first branch path connected to at least one third heat exchangers of the third unit and a second branch path connected to the second heat exchanger of the second unit. The first branch path merges with the second branch path before passing through the solenoid valve.

Optionally, in an embodiment of the heat pump system, the second branch path is provided with a third check valve that only allows the fluid flowing to the second heat exchanger to pass through.

The heat pump system according to the embodiments of the present invention has a simple structure.

BRIEF DESCRIPTION OF THE DRAWINGS

With reference to the drawings, the disclosure of the present invention will become easier to understand. It is easy for those skilled in the art to understand that these drawings are only for illustrative purposes, and are not intended to limit the scope of protection of the invention. In addition, similar numerals in the figures are used to denote similar components, among which.

DETAILED DESCRIPTION OF THE INVENTION

Figure 1:
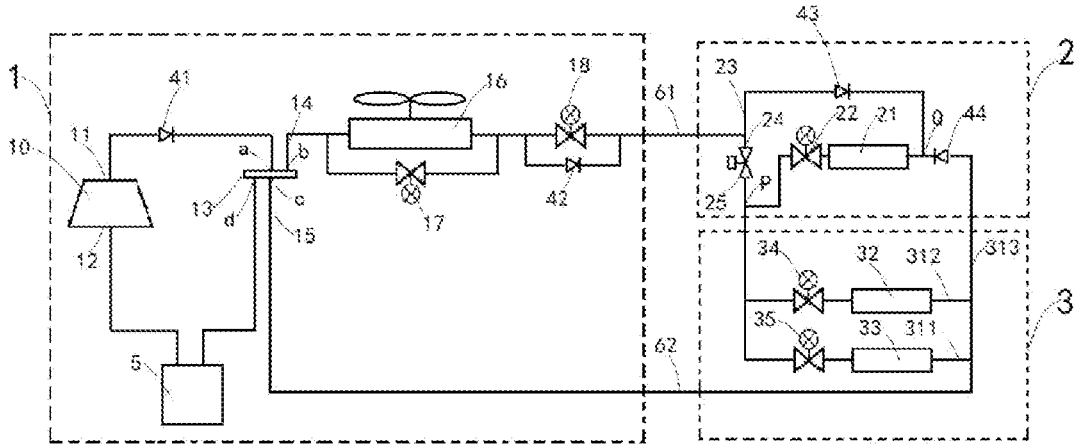
FIG. 1 shows a schematic structural diagram of a heat pump system according to an embodiment of the present invention.

Referring to FIG. 1, a schematic diagram of a heat pump system according to an embodiment of the present invention is illustrated. The heat pump system comprises: a first unit 1, a second unit 2, and a third unit 3. The first unit 1 may be, for example, an outdoor unit or an external unit, which is usually arranged outdoors, and may comprise a compressor 10. The compressor 10 may comprise a compressor inlet 12 and a compressor outlet 11. The compressor outlet 11 can be connected with a check valve 41, and then a switching device 13 is provided downstream of the check valve 41. The switching device 13 may be, for example, a four-way valve, which comprises four ports a, b, c, and d. The port a of the switching device 13 is connected to the compressor outlet 11, and the port d of the switching device 13 is connected to the compressor inlet 12 via a gas-liquid separator 5, which is used for separating gaseous and liquid refrigerants, for example. In addition, the port b of the switching device 13 is connected to a first flow path 14, and the port c of the switching device 13 is connected to a second flow path 15. The switching device 13 is switchable between a first position and a second position, so that the refrigerant compressed by the compressor 10 is delivered to the first flow path 14 or the second flow path 15, respectively. More specifically, in the embodiment of the four-way valve, in the first position, port a is connected to port b, and port c is connected to port d. In the second position, port a is connected to port c, and port b is connected to port d. A first heat exchanger 16 is arranged on the first flow path 14. The first flow path 14 of the first unit 1 is connected to the second unit 2 via, for example, a first pipeline 61. The second unit 2 can be a thermal unit for producing hot water. The second unit 2 may comprise a second heat exchanger 21, which may be used to exchange heat between the refrigerant and water in order to heat the water. The second flow path 15 of the first unit 1 is connected to the third unit 3 via, for example, a second pipeline 62. The third unit 3 may be, for example, an indoor unit or an internal unit, which may comprise at least one third heat exchangers 32, 33, wherein the at least one third heat exchangers 32, 33 may be used, for example, to regulate indoor temperature. In some embodiments, the at least one third heat exchangers 32, 33 may comprise a plurality of third heat exchangers connected in parallel. For example, as shown in FIG. 1, the third unit 3 comprises two third heat exchangers 32, 33 connected in parallel, which are respectively located on two branch paths 312, 311. And, the branch paths may each comprise corresponding first expansion devices 34, 35, such as an electronic expansion valve. The first expansion devices 34, 35 may, for example, perform a throttling function, or control the flow of refrigerant passing through each third heat exchanger based on the load by regulating the opening. For example, each of the third heat exchangers 32, 33 may correspond to an area in a house, so as to regulate the temperature of the area and so on.

In addition to the conventional cooling mode and heating mode, the heat pump system according to the embodiments of the present invention can also operate in a cooling and water heating mode and a heating and water heating mode, in which part of the heat is recovered for producing hot water. Specifically, in the cooling and water heating mode, the switching device 13 is switched to the first position. The heat pump system is configured to connect the first heat exchanger 16 and the second heat exchanger 21 in series, for example, through switch of the valve (in the illustrated embodiment, the second expansion device 18 is fully opened or closed and the solenoid valve 25 is closed). The refrigerant compressed by the compressor passes through the first heat exchanger 16 and the second heat exchanger 21 connected in series via the first flow path 14, passes through the corresponding third heat exchangers 32, 33 after being throttled by the first expansion devices 34, 35, and then returns to the compressor inlet 12 via, the second flow path 15.

Under such circumstances, the first heat exchanger 16 and the second heat exchanger 21 operate as condensers, while the at least one third heat exchangers 32, 33 operate as evaporators, and the first expansion devices 34, 35 perform a throttling function or act as expansion valves. In another aspect, in the heating and water heating mode, the switching device 13 is switched to the second position. The heat pump system is configured to connect the second heat exchanger 21 and the at least one third heat exchangers 32, 33 in parallel, for example, through switch of the valve (in the illustrated embodiment, by opening the solenoid valve, and regulating the opening of the first expansion devices 34, 35 and the flow regulating valve 22). The refrigerant compressed by the compressor passes through the second heat exchanger 21 and the at least one third heat exchangers 32, 33 connected in parallel via the second flow path 15, passes through the first heat exchanger 16 after being throttled by the second expansion device 18, and then returns to the compressor inlet 12 via the first flow path 14. In the heating and water heating mode, the second heat exchanger 21 and the at least one third heat exchangers 32, 33 operate as condensers, while the first heat exchanger 16 operates as an evaporator, and the second expansion device 18 performs a throttling function or acts as an expansion valve.

In some embodiments, the heat pump system may also operate in a cooling mode. In the cooling mode, the heat pump system is configured such that the switching device 13 is switched to the first position, and the second heat exchanger 21 is bypassed. For example, the first flow path 14 may be branched into a main flow path 23 passing through the second unit 2 and a bypass branch 24 after passing through the first pipeline 61. A second check valve 43, the second heat exchanger 21 and the flow regulating valve 22 are arranged in sequence on the Main flow path. The second check valve 43 only allows the fluid flowing to the second heat exchanger 21 to pass through. The flow regulating valve 22 is fully opened in the cooling and water heating mode, and is used to regulate the flow of refrigerant passing through the second heat exchanger 21 in the heating and water heating mode. The bypass branch 24 is connected to the third unit 3 and is provided with a solenoid valve 25 thereon. In the cooling and water heating mode, the solenoid valve 25 is closed and the flow regulating valve 22 is fully opened, so that the refrigerant passes through the main flow path 23, and passes through the check valve 43, the second heat exchanger 21 and the flow regulating valve 22 in sequence. However, when only cooling is required while water heating is not, the solenoid valve 25 can be opened and the flow regulating valve 22 can be closed, so that the refrigerant directly enters the third unit 3 without passing through the second heat exchanger 21, that is, the second heat exchanger 21 is bypassed.

In some embodiments, the first unit 1 further comprises a first regulating valve 17 connected in parallel with the first heat exchanger 16. In the cooling and water heating mode, the opening of the first regulating valve 17 can be regulated, so as to regulate the amount of refrigerant bypassing the first heat exchanger 16, in other words, to regulate the amount of refrigerant condensed in the first heat exchanger 16, or the proportion of the refrigerant condensed in the first heat exchanger 16 and the second heat exchanger 21. Specifically, for example, when there is a relatively high demand for water heating, the opening of the first regulating valve 17 can be increased, so that more refrigerant will bypass the first heat exchanger 16 to come to the second heat exchanger 21 to be condensed. Whereas, when there is a relatively low demand for water heating, the opening of the first regulating valve 17 can be reduced, so that more refrigerant will be condensed in the first heat exchanger 16. In another aspect, in the heating and water heating mode or the heating mode, the first regulating valve 17 is closed, so that all refrigerant passes through the first heat exchanger 16.

In some embodiments, after passing through the second pipeline 62, the second flow path 15 is branched into the first branch paths 311, 312 connected to the at least one third heat exchangers 32, 33 of the third unit 3, and a second branch path 313 connected to the second heat exchanger 21 of the second unit 2. The first branch paths 311, 312 and the second branch path 313 merge at a position P, and the refrigerant before passes through the solenoid valve 25. Subsequently, the refrigerant passes through the first pipeline 61 and the second expansion device 18 that performs a throttling function, and then returns to the compressor inlet 12 of the compressor 10 after passing through the first heat exchanger 16. In some embodiments, the second branch path 313 is provided with a third check valve 44 that only allows the fluid flowing to the second heat exchanger 21 to pass through. As shown in the figure, the second expansion device 18 that performs a throttling function in the heating mode or the heating and water heating mode is located downstream of the first heat exchanger 16 on the first flow path 14. The heat pump system further comprises a first check valve 42 connected in parallel with the second expansion device 18, wherein, in the heating mode or the heating and water heating mode, the first check valve 42 inhibits the passage of fluid so that all the fluid passes through the second expansion device 18, and the second expansion device 18 at this time performs a throttling function or acts as an expansion valve. In the cooling mode or the cooling and water heating mode, the second expansion device 18 is closed or fully open, and the refrigerant passing through the first heat exchanger 16 flows to the second heat exchanger 21 or directly flows to the at least one third heat exchangers 32, 33 via the first check valve 42 and/or the second expansion device 18.

In some embodiments, in the heating mode, the heat pump system is configured. to switch the switching device to the second position, and the branch path where the second heat exchanger 21 is located is shut off. For example, by closing the flow regulating valve 22, all the refrigerant passes through the at least one third heat exchangers 32, 33 at this time.

No matter in the cooling and water heating mode or the heating and water heating mode, the flow regulating valve 22 is located downstream of the second heat exchanger 21. As mentioned above, in the cooling and water heating mode, the flow regulating valve 22 is fully opened. In the heating and water heating mode, the flow regulating valve 22 controls the flow of refrigerant passing through the second heat exchanger 21. Therefore, in the heating and water heating mode, the opening of the flow regulating valve 22 and the first expansion devices 34 and 35 can be regulated based on the load to allocate the proportion of the refrigerant in each flow path.

Figure 2:
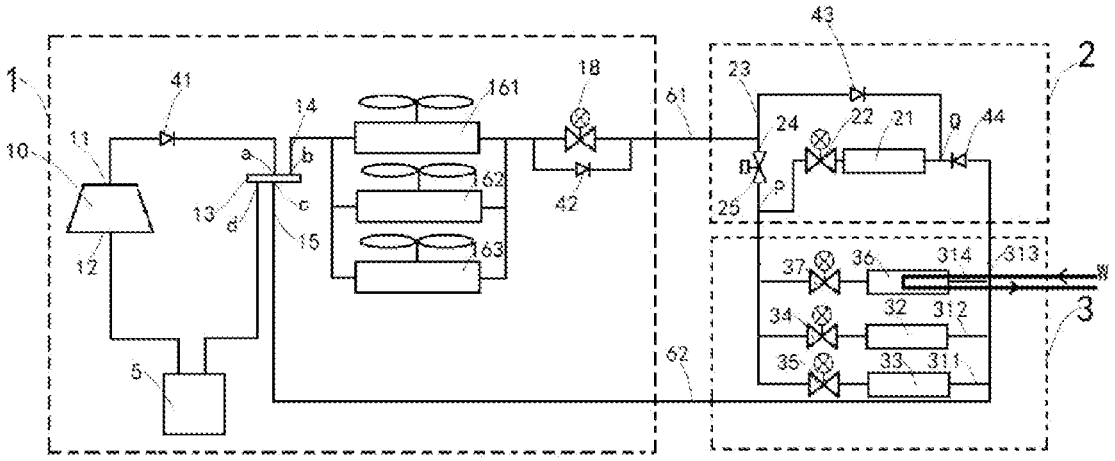
FIG. 2 shows a schematic structural diagram of a heat pump system according to another embodiment of the present invention.

With continued reference to FIG. 2, another embodiment of the heat pump system according to the embodiments of the present invention is introduced. In this embodiment, the at least one first heat exchangers comprise a plurality of heat exchangers connected in parallel, for example, a first heat exchanger 161, a second heat exchanger 162, and a third heat exchanger 163 connected in parallel shown in the figure. In the cooling and water heating mode, the number of activated heat exchangers can be controlled to regulate the amount of refrigerant condensed in the at least one first heat exchangers. For example, part of the first heat exchangers can be set to be direct pass-through without heat exchange. In addition, although not shown, a first regulating valve 17 connected in parallel with these first heat exchangers may also be provided as shown in FIG. 1. Furthermore, in the embodiment of FIG. 2, it is shown that in addition to the third heat exchangers 32, 33 for an air conditioning system, the third unit 3 may further comprise one or more third heat exchangers 36 for a floor heating system, which are arranged on the branch path 314 and can be connected in parallel with the other third heat exchangers 32, 33. The corresponding first expansion device 37 is also arranged on the branch path 314. The third heat exchangers 36 are used to exchange heat with the hot water flow W of the floor heating system.

The heat pump system according to the present invention can recover heat for hot water production, thereby improving the efficiency of the entire system. The internal components of the heat pump system, such as a relatively small number of control valves, makes the heat pump system simple in structure and easy to operate. In addition, the heat pump system according to the embodiments of the present invention comprises only two pipelines between the first unit 1 located outdoors and the second unit 2 and the third unit 3 located indoors, namely, a first pipeline 61 and a second pipeline 62, which simplifies the construction and reduces the construction cost compared with a system with more pipelines.

The specific embodiments described above are only used to describe the principle of the present invention more clearly, wherein each component is clearly shown or described to make the principle of the present invention easier to understand. Without departing from the scope of the present invention, those skilled in the art can easily make various modifications or changes to the present invention. Therefore, it should be understood that these modifications or changes should be included in the scope of patent protection of the invention.

What is claimed is:

1. A heat pump system, comprising:

a first unit comprising a compressor, a switching device connected to the compressor, a first flow path and a second flow path connected to the switching device, and at least one first heat exchangers on the first flow path, wherein the switching device is switchable between a first position and a second position so as to deliver refrigerant compressed by the compressor to the first flow path or the second flow path, respectively;

a second unit connected to the first flow path of the first unit, and comprising a second heat exchanger; and a third unit connected to the second flow path of the first unit and connected to the second unit, and comprising at least one third heat exchangers; wherein:

the heat pump system is capable of operating in a cooling and water heating mode and a heating and water heating mode, wherein, in the cooling and water heating mode, the heat pump system is configured to switch the switching device to the first position and connect the at least one first heat exchangers and the second heat exchanger in series, and refrigerant compressed by the compressor passes through the at least one first heat exchangers and the second heat exchanger connected in series via the first flow path, and returns to the compressor after passing through a first expansion device and the at least one third heat exchangers; and wherein, in the heating and water heating mode, the heat pump system is configured to switch the switching device to the second position and connect the second heat exchanger and the at least one third heat exchangers in parallel, refrigerant compressed by the compressor passes through the second heat exchanger and the at least one third heat exchangers connected in parallel via the second flow path, and returns to the compressor after passing through a second expansion device and the at least one first heat exchangers;

further comprising a cooling mode, wherein in the cooling mode, the heat pump system is configured to switch the switching device to the first position, and bypass the second heat exchanger.

2. The heat pump system according to claim 1, wherein the first unit comprises a first regulating valve connected in parallel with the at least one first heat exchangers, and wherein in the cooling and water heating mode, opening of the first regulating valve is regulated so as to regulate the amount of refrigerant bypassing the at least one first heat exchangers; in the heating and water heating mode, the first regulating valve is closed.

3. The heat pump system according to claim 1, wherein the at least one first heat exchangers comprise a plurality of first heat exchangers connected in parallel, and wherein in the cooling and water heating mode, the amount of refrigerant condensed in the at least one first heat exchangers is regulated by regulating the number of the first heat exchangers activated.

4. The heat pump system according to claim 1, wherein the at least one third heat exchangers comprise a plurality of third heat exchangers connected in parallel, and the first expansion device is provided on each of the branch paths where the third heat exchangers are located, and wherein the first expansion devices perform a throttling function in the cooling and water heating mode, and act as flow regulating valves in the heating and water heating mode to control the flow of refrigerant passing through the third heat exchangers.

5. The heat pump system according to claim 1, wherein the at least one third heat exchangers comprise heat exchangers for an air conditioning system and heat exchangers for a floor heating system.

6. The heat pump system according to claim 1, wherein in the cooling and water heating mode, the second expansion device is located downstream of the at least one first heat exchangers on the first flow path, and the heat pump system further comprises a first check valve connected in parallel with the second expansion device, and wherein in the cooling and water heating mode, the second expansion device is fully opened or closed, and the refrigerant passing through the at least one first heat exchangers flows to the second heat exchanger; in the heating and water heating mode, the first check valve inhibits the passage of fluid and the second expansion device performs a throttling function.

7. A heat pump system, comprising:

a first unit comprising a compressor, a switching device connected to the compressor, a first flow path and a second flow path connected to the switching device, and at least one first heat exchangers on the first flow path, wherein the switching device is switchable between a first position and a second position so as to deliver refrigerant compressed by the compressor to the first flow path or the second flow path, respectively;

a second unit connected to the first flow path of the first unit, and comprising a second heat exchanger; and a third unit connected to the second flow path of the first unit and connected to the second unit, and comprising at least one third heat exchangers; wherein:

the heat pump system is capable of operating in a cooling and water heating mode and a heating and water heating mode, wherein, in the cooling and water heating mode, the heat pump system is configured to switch the switching device to the first position and connect the at least one first heat exchangers and the second heat exchanger in series, and refrigerant compressed by the compressor passes through the at least one first heat exchangers and the second heat exchanger connected in series via the first flow path, and returns to the compressor after passing through a first expansion device and the at least one third heat exchangers; and wherein, in the heating and water heating mode, the heat pump system is configured to switch the switching device to the second position and connect the second heat exchanger and the at least one third heat exchangers in parallel, refrigerant compressed by the compressor passes through the second heat exchanger and the at least one third heat exchangers connected in parallel via the second flow path, and returns to the compressor after passing through a second expansion device and the at least one first heat exchangers;

wherein the first flow path is branched into a main flow path passing through the second unit and a bypass branch, and a second check valve, the second heat exchanger and a flow regulating valve are arranged in sequence on the main flow path, and wherein the second check valve only allows the fluid flowing to the second heat exchanger to pass through, the bypass branch is connected to the third unit and is provided with a solenoid valve thereon, and the flow regulating valve is fully opened in the cooling and water heating mode, and regulates the flow of the refrigerant passing through the second heat exchanger in the heating and water heating mode.

8. The heat pump system according to claim 7, wherein the second flow path is branched into a first branch path connected to the at least one third heat exchangers of the third unit and a second branch path connected to the second heat exchanger of the second unit, and the first branch path merges with the second branch path before passes through the solenoid valve.

9. The heat pump system according to claim 8, wherein the second branch path is provided with a third check valve that only allows the fluid flowing to the second heat exchanger to pass through.

10. A heat pump system, comprising:

a first unit comprising a compressor, a switching device connected to the compressor, a first flow path and a second flow path connected to the switching device, and at least one first heat exchangers on the first flow path, wherein the switching device is switchable between a first position and a second position so as to deliver refrigerant compressed by the compressor to the first flow path or the second flow path, respectively;

a second unit connected to the first flow path of the first unit, and comprising a second heat exchanger; and a third unit connected to the second flow path of the first unit and connected to the second unit, and comprising at least one third heat exchangers; wherein:

the heat pump system is capable of operating in a cooling and water heating mode and a heating and water heating mode, wherein, in the cooling and water heating mode, the heat pump system is configured to switch the switching device to the first position and connect the at least one first heat exchangers and the second heat exchanger in series, and refrigerant compressed by the compressor passes through the at least one first heat exchangers and the second heat exchanger connected in series via the first flow path, and returns to the compressor after passing through a first expansion device and the at least one third heat exchangers; and wherein, in the heating and water heating mode, the heat pump system is configured to switch the switching device to the second position and connect the second heat exchanger and the at least one third heat exchangers in parallel, refrigerant compressed by the compressor passes through the second heat exchanger and the at least one third heat exchangers connected in parallel via the second flow path, and returns to the compressor after passing through a second expansion device and the at least one first heat exchangers;

further comprising a heating mode, wherein in the heating mode, the heat pump system is configured to switch the switching device to the second position, and shut off the branch path where the second heat exchanger is located.

* * * * *